US006299954B1

(12) United States Patent
Schulte

(10) Patent No.: US 6,299,954 B1
(45) Date of Patent: Oct. 9, 2001

(54) ADHESIVE BODY

(75) Inventor: Axel Schulte, Holzgerlingen (DE)

(73) Assignee: Firma Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/367,110

(22) PCT Filed: May 13, 1998

(86) PCT No.: PCT/EP98/02811

§ 371 Date: Aug. 10, 1999

§ 102(e) Date: Aug. 10, 1999

(87) PCT Pub. No.: WO99/27811

PCT Pub. Date: Jun. 10, 1999

(30) Foreign Application Priority Data

Nov. 28, 1997 (DE) ..... 197 52 763

(51) Int. Cl.[7] ..... A44B 21/00

(52) U.S. Cl. ..... 428/40.1; 428/99; 428/120; 428/900; 24/442

(58) Field of Search ..... 428/100, 99, 120, 428/900, 40.1; 24/306, 444, 442

(56) References Cited

U.S. PATENT DOCUMENTS 4,693,921 * 9/1987 Billarant et al. ..... 428/100
4,931,344 * 6/1990 Ogawa et al. ..... 428/100
5,180,618 * 1/1993 Kessler et al. ..... 428/100
5,766,385 * 6/1998 Pollard et al. ..... 428/100
5,972,465 * 10/1999 Ohno et al. ..... 428/100

FOREIGN PATENT DOCUMENTS 0145603 6/1985 (EP) .
0168240 1/1986 (EP) .
0612485 8/1994 (EP) .
0621118 10/1994 (EP) .
97/20690 6/1997 (WO) .

* cited by examiner

*Primary Examiner*—Alexander S. Thomas
(74) *Attorney, Agent, or Firm*—Roylance, Abrams, Berdo & Goodman, L.L.P.

(57) ABSTRACT

An adhesive body, for the production of a junction with a foam material molded body during the molding process involving foam materials, has individual adhesive elements arranged on a support strip and covered to avoid the penetration of foam material with a covering. The covering is an adhesive material, adhering to the front side of the adhesive elements and can be removed therefrom to expose the adhesive elements. The adhesive body can be used at lower cost, can be in tight junction with the foam material molded body, and can guarantee with greater certainty that no foam material gets onto the adhesive elements during the foaming.

17 Claims, 2 Drawing Sheets

ADHESIVE BODY

FIELD OF THE INVENTION

The present invention relates to an adhesive body, especially an adhesive or fastening body for producing a junction with a foam material molded body during the molding procedure of the foam material. Individual adhesive or fastening elements, arranged on a support strip, are covered with a surface-forming covering facing inward from the exterior to avoid penetration of foam material into the adhesive or fastening elements.

BACKGROUND OF THE INVENTION

An adhesive or fastening body disclosed in EP 0 612 485 B1 has a traditional adhesive fastening part for the foaming in the foam material molded body. The adhesive fastening part is provided with catch elements on its front surface. The reverse side of this adhesive fastening part has an anchoring part for the anchoring of the adhesive body in the surface of the foam molded material molded body to be foamed. The disclosed catch or adhesive elements are covered over their entire surface by a plastic sealing material during the foaming. Following completion of the molding procedure, the plastic sealing material can be torn off this surface to expose the catch elements. Seat coverings, padded parts or the like could then be mounted on the exposed catch elements and connected with the foam material molded body. The corresponding adhesive fastening parts, for example in the form of a loops-strip material or the like, are brought into engagement with the catch elements. Since the plastic sealing material surrounds the adhesive elements to be covered, form-locking in the shape of the catch elements, considerable force is required to separate the covering material from the adhesive elements, and the required mold-release forces can be greater than the connection forces between the specific adhesive bodies in the form of the adhesive fastening and the foam material. As a result, together with the covering sealing material one also tears off the strip-like adhesive body from the freshly foamed foam material seat body, which leaves this seat degraded beyond the possibility of use. Even if the sealing material is recyclable and can be used again for subsequent molding procedures, a corresponding quantity of material is to be handed for re-use of the sealing material, which makes the known molding procedure more costly.

In EP 0 168 240 A2, with the same sort of adhesive body and with comparable molding processes, the anchoring elements of an adhesive fastening part are covered on the frontal side only, using a thin foil, to avoid the penetration of the molding material. However, this process requires costly sealing measures in the border area of the foil, must eventually require a connection with the top of the adhesive fastener strip, increases the cost, especially in the frontal area of the strip-like adhesive fastener part, leads to sealing problems with the result that the foam material is even allowed the possibility of penetrating between the catch elements. The catch elements surrounded by foam material are then no longer available for the subsequent attachment of padding coverings and padding material, correspondingly prejudicing the possibilities of establishing secure arrangements. Also, the foil is easily torn off and can be torn off, which in practice leads to further problems.

SUMMARY OF THE INVENTION

Objects of the present invention are to provide an improved adhesive or fastening body that can save costs, can be tightly connectable with the foam material molded body, and can guarantee with greater assurance that during the foaming no foam material gets into the adhesive or catch elements.

These objects are basically obtained by the covering means itself being in the form of an adhesive means, supported and adhered upon the frontal side of the adhesive elements. It can be removed from these elements, thus exposing the adhesive elements. During the generation of foam, the adhesive elements are securely covered and the foam material cannot adhere to the adhesive elements during the foaming and cannot leave them unusable. Since the adhesive means is supported and adheres detachably to the adhesive elements, the strip-like or surface-like adhesive means is easy to separate from the adhesive elements. Undesired tearing of the adhesive body out of the foam material molded body does not occur. Besides, during generation of the foam, this adhesive covering means is connected securely with the adhesive elements, so that undesired tearing into that material cannot occur.

The coating, in the form of the adhesive material, can be a very thinly constructed coating, so that only a quite small amount of material need be required for the covering. This lowers the material cost, and it can be stored and travels well to market at low cost.

In one preferred embodiment of the adhesive body of the present invention, the adhesive means can be selected from among the melting adhesive materials, especially from among the so-called hot-melt-adhesives, or from among the dispersion adhesive materials, preferably on an aqueous phenol resin base, or from among the adhesives on a acrylate base. Such adhesives are characterized especially by very good adhesive strength on the plastic materials which are in question in this case. Besides, they are weather-resistant and water-resistant, and consequently are very appropriately in the position to effectively avoid undesired penetration of the foam material during the foam molding procedure. While in the technical information papers regarding these adhesive materials their strongly adhering property is emphasized above all, for an expert in the art of adhesive strip fasteners, it is surprising that these strip fasteners can be easily detached from the adhesive elements of such an adhesive fastening part, insofar as the adhesive elements preferably incorporate no hook-shaped configuration, but rather are truncated on the frontal side.

In another preferred embodiment of the adhesive body according to the present invention, on the side of the support strip facing the covering means is a loop material, preferably of cotton. The loop material guarantees an extensive junction with the foam material. Preferably, the loop material is arranged on a flat strip which can be provided as an integral part of the support strip or can be connected with the support strip. With the described arrangements, a secure junction of the adhesive body with the foam material can be produced during the generation of foam, such that neither with the removal of the adhesive material covering means nor with the subsequent tearing off of a fastener article on the seat covering is the foam-covered adhesive body part separated from the foam material.

With another especially preferred embodiment, the adhesive material means in an adhesive strip which can be rolled up and rolled out. On its exterior side turned away from the adhesive elements it is provided with a removable magnetic foil or a foil having a covering incorporating magnetizable particles, such as iron particles, or having a covering of silicon. Through the development or shaping of the adhesive material means as an adhesive strip which can be rolled out or rolled up, the adhesive means can be processed as a sort of foil. The production of the adhesive body requires no costly equipment, such as smelting devices and coating or application devices. Any extruding mechanism can be used for the application of the covering foam. More than that, simple feed devices and a pressure roller will suffice. Insofar as the adhesive body is provided with a removable magnetic foil or a covering layer with magnetizable particles, such strip-like adhesive body can be inserted in the mold with magnetic mounting, over so-called pipes or channels, and simply and securely adhered in the mold. During foaming in the mold, it can be held securely in its position in such a manner that during foaming in the mold it is not subjected to any dislocation or the like. Insofar as a silicon-coated covering layer is provided, the adhesive strip has an adhesive layer on both sides and consequently also an adhesive layer facing inward from the exterior. The adhesive layer can be detachably connected directly with the mold or its parts, such as pipes or channels.

Insofar as the adhesive elements of the adhesive body are formed of stalk-like thickenings or enlarged areas on the support strip, which are flattened on the frontal side or have concave depressions, these constructions can be extremely low in height. The process of rolling out the adhesive means producing such adhesive body is simplified.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form apart of this disclosure.

DETAILED DESCRIPTION OF THE INVENTION

Figure 1:
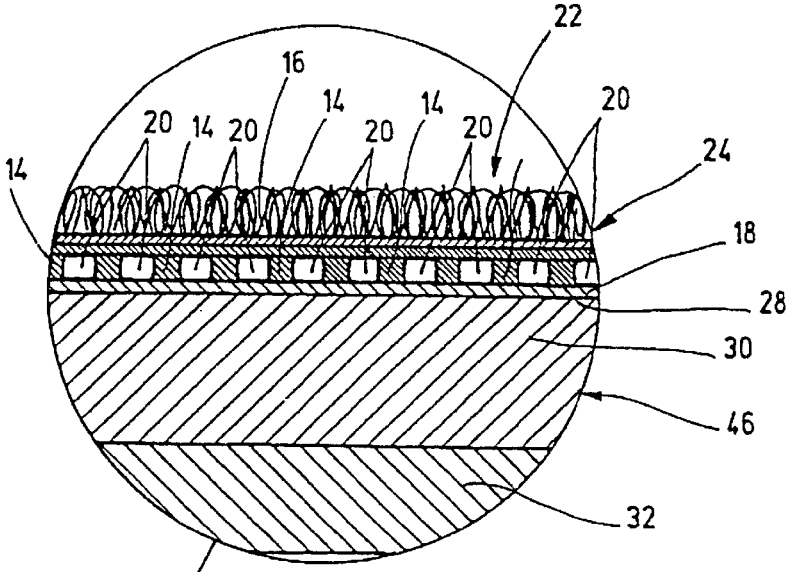
FIG. 1 is an enlarged side elevational view in section of an adhesive body according to a first embodiment of the present invention.

The adhesive body according to the present invention is especially for the production of a junction with a foam material molded body 10 during the molding procedure involving foam material. Such foam material molded bodies 10 form foam material blanks, especially blanks for motor vehicle and aircraft passenger seats as well as their parts, such as seat parts, backrests, armrests and head supports. This also encompasses seat assembly members, by which these individual seat components are assembled into one seat structure. Dependent upon the specific molded body to be produced, a mold 12 or a molding box is provided, into which the foam material is introduced under pressure. Following termination of a heat treatment in mold 12, and a subsequent cooling process, molded body 10 can be removed from mold 12 for further processing.

So that such a manufactured foam material molded body 10 can be provided with a coating material or the like, adhesive bodies in the form of strips are inserted into mold 12 and are foamed up with it. Corresponding complementarily constructed adhesive fastener parts on the coating material, but not shown in the drawing, cooperate with adhesive elements 14 of the adhesive body securely fastened to molded body 10, to fasten the covering to the foam material molded body 10.

The individual adhesive elements 14 are arranged on a support strip 16 preferably as one integral element with this support strip. To avoid undesired penetration of foam material, adhesive elements 14 are covered with a covering 18.

Figure 1A:
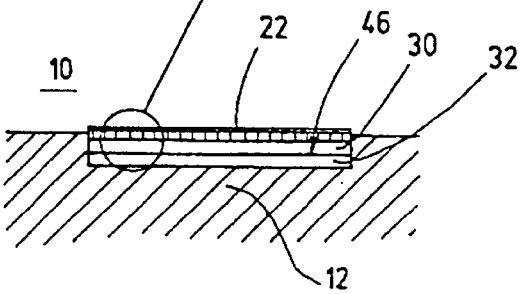
FIG. 1*a* is a side elevational view in section of the adhesive body of FIG. 1 in a mold.

Covering 18 is an adhesive material which, as shown especially in FIGS. 1 and 1*a*, rests on adhesive elements 14 and frees a uniformly arranged, radial or lateral spacing 20 between adhesive elements 14. Covering 18, in the form of the adhesive material, can be applied in foil form, engages or adheres on the frontal side, and is supported on the adjacent facing side of support strip 16. The adhesive can be selected from among melted adhesive materials, which are also known as hot-melt-adhesives, from among dispersion adhesive materials, which preferably are on an aqueous phenol resin base, or from among adhesive materials based on acrylate.

A loop material 22 is found on the side of support strip 16 opposite covering 18, and is preferably of cotton. The loop material guarantees a strong junction with the foam material during the foaming process. The foam material penetrates between the individual loops of the loop material arranged on a flat strip 24. The penetrating foam yields a tight bond as soon as the foam material has hardened.

In one embodiment, the adhesive means, configured as an adhesive strip which can be rolled up and rolled out, has a removable magnetic foil 30 or a comparable covering layer having magnetizable particles, not shown, such as iron particles on its exterior side 28 turned away from adhesive elements 14. The removable magnetic foil 30 guarantees that the adhesive body is held in mold 12. Mold 12 has mountings 32 constructed of corresponding dimensions and provided with magnetic inserts, for example in the form of magnetic rods, not shown. These mountings 32 also can be removed from mold 12. When the molding process is terminated, magnetic foil 30 together with covering 18 is preferably withdrawn, and adhesive elements 14 are released for the next operation.

Adhesive elements 14 are formed of stalk-like thickened or enlarged areas on support strip 16, which are flattened in the frontal area. From the longitudinal transverse sectional point of view, elements 14 taper inward and are cylindrical. Other cross sections, such as rectangular, elliptical or the like, are also possible. Furthermore the stalk-like enlarged areas can have not shown concave depressions on their free frontal area. Preferably adhesive elements 14 are of one piece integral with support strip 16 and are formed of a plastic material.

One expedient method of production for the manufacture of such an adhesive body is disclosed in DE 196 46 318.1. For the manufacture of the adhesive body with the plurality of adhesive elements 14 configured of one integral piece with support strip 16 in the form of thickened projecting stalks, a thermoplastic plastic is fed in plastic or liquid state into a gap between a pressure roll or platen and a grooved or shaped roll (not shown). The two rolls are driven in opposite directions of rotation. The grooved roll has a sieve with outwardly and inwardly aligned open hollow spaces. The hollow spaces of the exterior contour correspond to stalk-like adhesive elements 14. The thermoplastic plastic penetrates unto the sieve and there hardens at least partially. Adhesive elements 14 thus produced are of only very small height and stand tightly together. Consequently, it is not possible that the adhesive means in the form of covering 18 engage or extend in the spaces 20 between adhesive elements 14 to simplify the withdrawal of covering 18 from adhesive elements 14.

Figure 3:
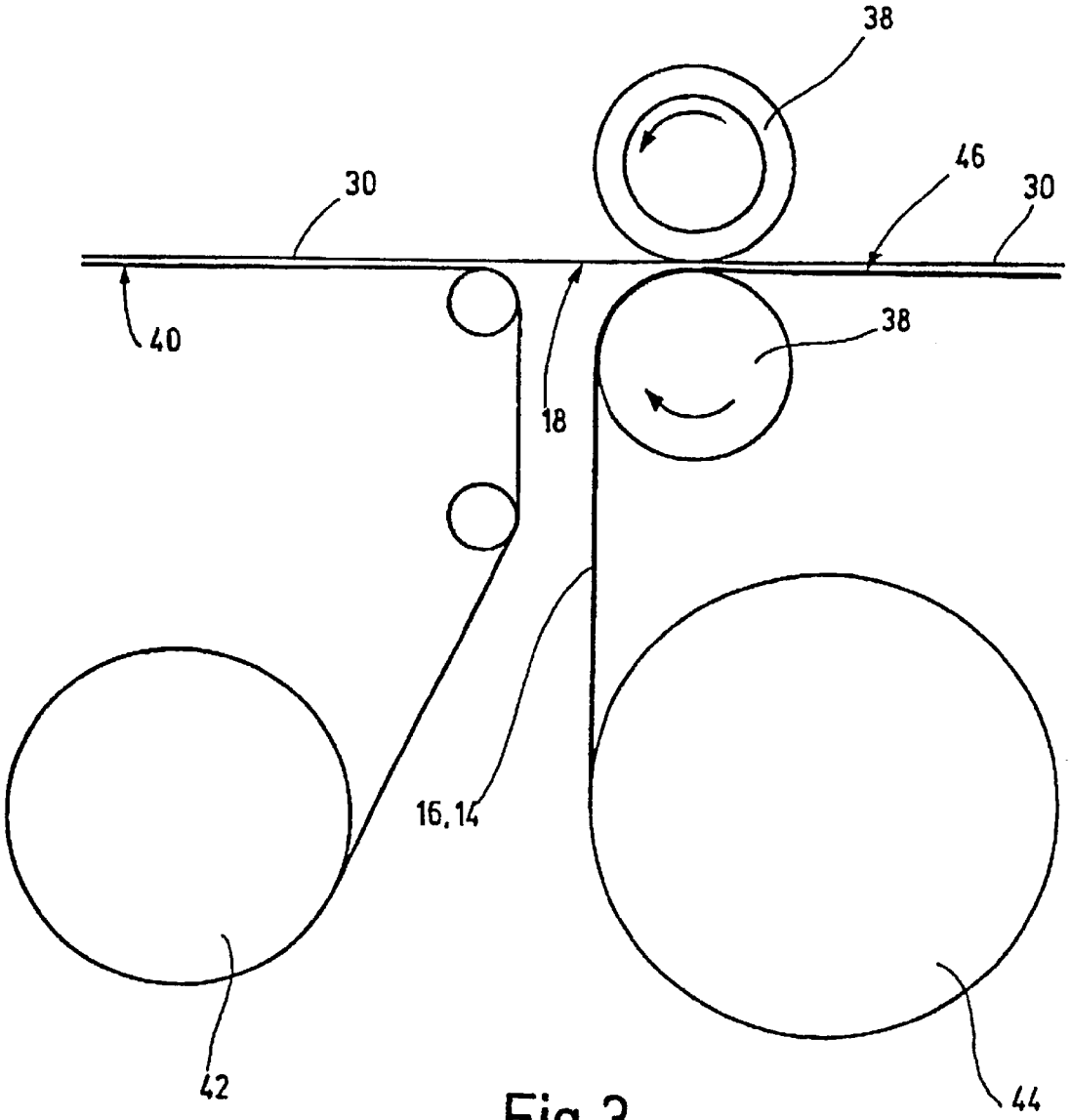
FIG. 3 is a side elevational view schematically illustrating a device for producing an adhesive body according to the present invention.

The device shown diagrammatically in FIG. 3 is the arrangement by which the adhesive body can be produced. The magnetic foil or iron-containing paper 30 is guided through between two rubber coating rollers 38, each of which runs in the direction of its arrow. Covering 18 in the form of the adhesive strip extends on the bottom of magnetic foil or of the paper 30. Before the bonding generated between the two rubber coating rollers 38 is carried out, a covering paper 40 protecting the adhesive means is drawn through, and, as shown in FIG. 3, is correspondingly wound on a roll 42. Parallel to that, support strip 16, along with then outward projecting adhesive elements 14, is unwound from an unrolling reel 44. In the direction of viewing shown in FIG. 3, top rubber coating roll 38 then presses the adhering covering 18 on support strip 16. The completed and already described wide product 46 is produced, as is shown more clearly in FIGS. 1 and 1*a*.

With this production of the adhesive body, one is not absolutely required to use strip materials as narrow or small products. Moreover, all component parts of the described laminates can be produced as so-called wide products and can be joined together, and indeed permanently joined together to a width of up to approximately 1.5 m. With this wide product 46, it is possible to draw off portions and feed them to a rolling-cutting machine or reel-cutting machine or the like to obtain strips of the desired width and dimensions. Complicated two- and three-dimensional shapes can also be attained for seat construction, by punching, by water jet cutting or by means of a laser beam. The processing of the cut borders by means of adhesion or gluing or welding before use in foam mold 12 can also be deleted, in that the material can be brought directly from the relevant supply roll 44, resulting in considerable savings in cost.

Figure 2A:
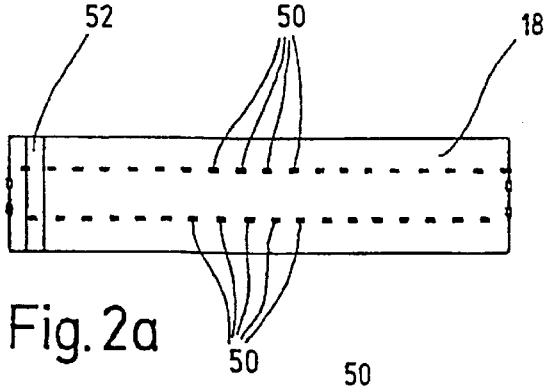
FIG. 2*a* is a top plan view of an adhesive body according to a second embodiment of the present invention.
Figure 2B:
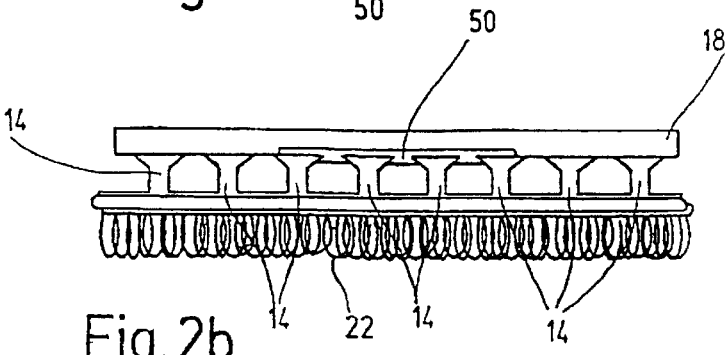
FIG. 2*b* is a side elevational view of the adhesive body of FIG. 2*a*.

Another embodiment is illustrated in FIGS. 2*a* and 2*b*. When adhering covering 18 engages over the entire area of adhesive elements 14, relatively high manual forces are required for the removal of covering 18. To facilitate this detachment and removal process, a non-adhering band 50 is provided in the second embodiment shown in FIGS. 2*a*, 2*b*, to be rolled up together with it. Band 50 comes to lie between covering 18 and adhesive elements 14 which are to be covered. Since no adhering contact between covering 18 and adhesive elements 14 takes place at the contact points of non-adhesive band 50, the manual removal process for covering 18 is simplified. Non-adhering band 50 can be applied as a band or as foil or, as shown in FIG. 2*a*, covering 18 can be applied engaging and supported from below at a certain spacing.

Furthermore, as shown in FIG. 2*a*, covering 18 can be provided with a handle or grip 52 aligned transverse to its longitudinal alignment or axis. Grip 52 offers aid in gripping the unit. In the direction of viewing seen in FIG. 2*a* viewed from handle 52 outward, covering 18 is glued onto adhesive elements 14 flush with the right side and is left unattached flush with the left side. The adhesive material can naturally harden into an adhering foil coating or, as a coating on the thin layer of foil, and can produce the junction with adhesive elements 14.

While various embodiments have been chosen to illustrate the invention, it will be understood by those skilled in the art that various changes and modifications can be made therein without departing from the scope of the invention as defined in the appended claims.

What is claimed is:

1. An adhesive body for producing a junction with a foam material molded body during molding of foam material, comprising:

a support strip;

adhesive elements arranged on said support strip, said adhesive elements being stalk-like enlarged areas on said support strip and having flattened front ends remote from said support strip; and a surface covering having adhesive on an inner surface thereof adhering said covering to said flattened front ends of said adhesive elements to avoid penetration of the foam material into spaces between said adhesive elements during molding of the foam material, said covering being removable from said adhesive elements to expose said adhesive elements for use upon completion of the molding.

2. An adhesive body according to claim 1 wherein said adhesive is a melting adhesive material.

3. An adhesive body according to claim 1 wherein said adhesive is a dispersion adhesive material.

4. An adhesive body according to claim 1 wherein said adhesive has an aqueous phenol resin base.

5. An adhesive body according to claim 1 wherein said adhesive has a acrylate base.

6. An adhesive body according to claim 1 wherein said support strip has loop material on a side thereof remote from said covering for forming a tight junction with the foam material.

7. An adhesive body according to claim 6 wherein said loop material is cotton.

8. An adhesive body according to claim 6 wherein said loop material is arranged on a flat strip that is an integral part of said support strip.

9. An adhesive body according to claim 6 wherein said loop material is arranged on a flat strip that is connected with said support strip.

10. An adhesive body according to claim 1 wherein non-adhering cover material is partially fitted between said adhesive elements and said covering.

11. An adhesive body according to claim 10 wherein said non-adhering material is a non-adhering band.

12. An adhesive body according to claim 1 wherein said covering is an adhesive strip that can be rolled out and rolled up, said adhesive strip having an exterior surface remote from said adhesive elements provided with a removable magnetic foil.

13. An adhesive body according to claim 1 wherein said covering is an adhesive strip that can be rolled out and rolled up, said adhesive strip having an exterior surface remote from said adhesive elements provided with a layer having magnetizable particles.

14. An adhesive body according to claim 13 wherein said magnetizable particles are iron particles.

15. An adhesive body according to claim 1 wherein said covering is an adhesive strip that can be rolled out and rolled up, said adhesive strip having an exterior surface remote from said adhesive elements, said exterior surface having a silicon-coated covering layer.

16. An adhesive body according to claim 1 wherein said flattened front ends have concave depressions.

17. An adhesive body according to claim 1 wherein said covering includes a handle to facilitate removal from said adhesive elements.

* * * * *